US009926114B2

(12) United States Patent
Eberlein

(10) Patent No.: US 9,926,114 B2
(45) Date of Patent: Mar. 27, 2018

(54) QUICK RELEASE BASE AND LID ASSEMBLY CONTAINER

(71) Applicant: HCT GROUP HOLDINGS LIMITED, Central (HK)

(72) Inventor: David Jeffrey Eberlein, Los Angeles, CA (US)

(73) Assignee: HCT GROUP HOLDINGS LIMITED, Hong Kong (HK)

( * ) Notice: Subject to any disclaimer, the term of this patent is extended or adjusted under 35 U.S.C. 154(b) by 262 days.

(21) Appl. No.: 14/858,316

(22) Filed: Sep. 18, 2015

(65) Prior Publication Data

US 2016/0083152 A1 Mar. 24, 2016

Related U.S. Application Data

(60) Provisional application No. 62/052,104, filed on Sep. 18, 2014.

(51) Int. Cl.
*B65D 45/16* (2006.01)
*A45D 33/00* (2006.01)

(52) U.S. Cl.
CPC ..... *B65D 45/16* (2013.01); *A45D 33/00* (2013.01)

(58) Field of Classification Search
CPC ..... B65D 50/08; B65D 50/14; B65D 41/02; B65D 50/045; B65D 50/04; B65D 41/18
USPC ..... 220/281; 215/201, 216, 317
See application file for complete search history.

(56) References Cited

U.S. PATENT DOCUMENTS

D35,976 S 7/1902 McCormick
1,527,052 A 2/1925 McAndrews
1,748,491 A 2/1930 May
D83,668 S 3/1931 Shebinin
D94,984 S 3/1935 Noble
D139,903 S 1/1945 Baff
3,130,433 A 4/1964 John
(Continued)

FOREIGN PATENT DOCUMENTS

EP 2471406 A1 7/2012
FR 2763811 A1 12/1998
(Continued)

OTHER PUBLICATIONS

PCT Application No. US2015/050990, The International Search Report and the Written Opinion of the International Searching Authority. 11 Pages. dated Sep. 18, 2015.
(Continued)

*Primary Examiner* — Jeffrey Allen
(74) *Attorney, Agent, or Firm* — Seager, Tufte & Wickhem LLP

(57) ABSTRACT

A quick release container is provided that includes a base having a base perimeter with a well configured to hold a product, and a lid assembly configured to be removably coupled to the base. The lid assembly includes a lid having: (i) an outer portion extending around a top of the base and having a height extending from the top of the base; and (ii) an inner portion extending between a perimeter of the outer portion and disposed over the well of the base. The lid assembly also includes a depressible element extending between the perimeter of the outer portion, spaced from the inner portion and configured to move along the height of the outer portion, and a clamping device coupled to the lid and removably coupled to the base.

19 Claims, 17 Drawing Sheets

(56) References Cited

U.S. PATENT DOCUMENTS 3,476,123 A 11/1969 Flax
3,599,821 A * 8/1971 Eggert ..... B65D 50/045 215/301
3,886,618 A 6/1975 Paoletti
4,095,713 A 6/1978 Norton
4,157,764 A 6/1979 Moller
4,165,755 A 8/1979 Cassai
4,180,178 A 12/1979 Turner
D268,292 S 3/1983 Chevassus
D269,067 S 5/1983 Ballereaud
4,421,127 A 12/1983 Geer
D281,731 S 12/1985 Phu
4,586,623 A * 5/1986 Hatakeyama ..... B65D 41/02 215/301
4,676,393 A * 6/1987 Daniel ..... B60K 15/0406 220/281
D293,612 S 1/1988 Bulwik
D293,944 S 1/1988 Trabattoni
D301,771 S 6/1989 Bakic
5,005,697 A 4/1991 Jimbo et al.
D316,763 S 5/1991 Ferrari
5,353,818 A 10/1994 Suzuki et al.
D353,100 S 12/1994 Mandel
D353,101 S 12/1994 Desgrippes
5,431,176 A 7/1995 Favre
D361,159 S 8/1995 Feng
D365,892 S 1/1996 Markham
5,603,340 A 2/1997 Gueret
5,655,553 A 8/1997 Giese et al.
D386,972 S 12/1997 Stoecker
5,713,471 A 2/1998 Gueret
5,813,420 A 9/1998 Sussman
5,839,626 A 11/1998 Gross et al.
D405,013 S 2/1999 Schaeffer
5,875,795 A 3/1999 Bouix
5,896,866 A 4/1999 Quennessen
5,976,616 A 11/1999 Wayne
D422,120 S 3/2000 Orsomando
D425,794 S 5/2000 Grossnickle
6,059,474 A 5/2000 Huang
D428,209 S 7/2000 Kudo et al.
6,119,891 A 9/2000 Favre
D432,724 S 10/2000 Gavin
6,138,686 A 10/2000 Yuhara
D434,875 S 12/2000 Gavin
6,173,719 B1 1/2001 Petit
D439,019 S 3/2001 Motosko
D439,376 S 3/2001 Lerolle et al.
6,202,902 B1 3/2001 Starr
D442,868 S 5/2001 Gavin
6,315,479 B1 11/2001 Sakurai
6,336,460 B2 1/2002 Yuhara
6,354,308 B1 3/2002 Kuk
D457,687 S 5/2002 Millar
D457,986 S 5/2002 Rodriguez et al.
D468,058 S 12/2002 Thorpe
D471,108 S 3/2003 Calderone, Jr.
D479,630 S 9/2003 Lai
D481,319 S 10/2003 Orsomando
D485,018 S 1/2004 Beilman
D487,703 S 3/2004 Orsomando
D498,024 S 11/2004 Leppla et al.
D498,146 S 11/2004 Densky et al.
D498,422 S 11/2004 Theunynck
D503,245 S 3/2005 Vanoncini
D505,518 S 5/2005 Benjamin et al.
D507,078 S 7/2005 Greenfield
D513,873 S 1/2006 Bochno et al.
6,997,321 B2 2/2006 Young
D532,936 S 11/2006 Bakic
D535,104 S 1/2007 Chen
D535,441 S 1/2007 Maddy
7,172,357 B2 2/2007 Gueret
D539,481 S 3/2007 Lui
7,240,402 B2 7/2007 Suzuki et al.
D551,987 S 10/2007 Kuethe et al.
D554,292 S 10/2007 Thorpe
D554,293 S 10/2007 Thorpe
D554,294 S 10/2007 Thorpe
D554,804 S 11/2007 Bernard
7,334,685 B2 2/2008 Mathiez
D564,707 S 3/2008 Barresi
7,337,787 B2 3/2008 Matsuoka
D566,899 S 4/2008 De Baschmakoff
D576,354 S 9/2008 Dominski et al.
D576,770 S 9/2008 Mascotte et al.
D581,597 S 11/2008 Martinez
D586,504 S 2/2009 Moon
7,494,030 B2 2/2009 Bennett
D592,956 S 5/2009 Thiellier
D595,900 S 7/2009 Yamamoto
D600,857 S 9/2009 Maddy et al.
7,614,405 B2 11/2009 Allen et al.
D611,657 S 3/2010 Maddy et al.
D616,608 S 5/2010 Maddy
D626,289 S 10/2010 Lee
7,815,067 B2 10/2010 Matsumoto et al.
7,828,000 B2 11/2010 Lee
7,832,564 B2 11/2010 Kim
D633,653 S 3/2011 Lee
D642,333 S 7/2011 Praster
D645,617 S 9/2011 Mahdavi
D655,046 S 2/2012 Nakamura
D656,824 S 4/2012 Haile
D663,483 S 7/2012 Lee
D666,773 S 9/2012 Greenfield
D678,074 S 3/2013 De France
D679,604 S 4/2013 Sung
D688,420 S 8/2013 Lai
D693,059 S 11/2013 Tani
8,590,545 B2 11/2013 Won
D696,816 S 12/2013 Kordulla et al.
D698,256 S 1/2014 Thompson
D705,074 S 5/2014 Della Valle
D705,663 S 5/2014 Guichot
D714,157 S 9/2014 Albertini
D715,653 S 10/2014 Lavigne et al.
D716,148 S 10/2014 DeMarco et al.
D723,220 S 2/2015 Guor
D728,860 S 5/2015 Blanch
D743,101 S 11/2015 Pires et al.
2002/0096185 A1 7/2002 Givens
2002/0162565 A1 11/2002 Sebban
2004/0206370 A1 10/2004 Byun
2006/0027481 A1 2/2006 Gelardi et al.
2006/0072956 A1 4/2006 Tanaka et al.
2006/0118454 A1 6/2006 Kang, III
2006/0151421 A1 7/2006 Rho
2007/0029226 A1 2/2007 Yuhara et al.
2007/0131240 A1 6/2007 Prague
2007/0235056 A1 10/2007 Vintimiglia et al.
2007/0278229 A1 12/2007 Li
2008/0023023 A1 1/2008 Boye et al.
2008/0302384 A1 12/2008 Parker
2009/0272399 A1 11/2009 Kim, II
2009/0288677 A1 11/2009 Chen
2009/0293902 A1 12/2009 Ramos
2009/0320874 A1 12/2009 Boye et al.
2010/0031971 A1 2/2010 Ha
2010/0089862 A1 4/2010 Schmitt
2010/0215422 A1 8/2010 Carroll et al.
2010/0288299 A1 11/2010 Won
2010/0307530 A1 12/2010 Bennett
2011/0176854 A1 7/2011 Nobles
2011/0266297 A1 11/2011 Thorpe et al.
2012/0136748 A1 5/2012 Shasteen et al.
2012/0266907 A1 10/2012 Chan
2013/0004226 A1 1/2013 Breidenbach et al.
2013/0051894 A1 2/2013 Lim et al.
2013/0284202 A1 10/2013 Limongi et al.

(56) References Cited

U.S. PATENT DOCUMENTS

| | | | |
|---|---|---|---|
| 2014/0023689 | A1 | 1/2014 | Kim et al. |
| 2014/0154295 | A1 | 6/2014 | Sim et al. |

FOREIGN PATENT DOCUMENTS

| | | | |
|---|---|---|---|
| FR | 2806272 | A1 | 9/2001 |
| FR | 2806893 | A1 | 10/2001 |
| JP | 5945015 | U | 3/1984 |
| JP | 2533414 | Y2 | 4/1997 |
| WO | 2008010628 | A1 | 1/2008 |
| WO | 2010055445 | A3 | 7/2010 |

OTHER PUBLICATIONS

Reitas, Jr., Nanomedicine, Images, Foresight Institute, 1 page, Feb. 11, 2001.

Hobson, "Mechanical Iris Will Make You Want a Laser Cutter Even More", Hackday.com, 10 pages, Mar. 24, 2014.

Lorac Pro Cream Eyeliner + Brush: Eyeliner, retrieved on May 29, 2013, at <<http://www.sephora.com/pro-creameyeliner-brush-P374705?skuId=1432400>> 4 pages.

Nest-filler, retrieved on May 5, 2010 at <<http://www.nest-filler.com/cosmetics/view.htm?pageno=&bimil=&idx=1328&cate1=1220334097&cate1_1=&cate2=&cate3=,>>1 page.

Sephora Collection, Pitch BlacK All-In-1 Waterproof Eye Liner, retrieved on May 29, 2013 <<http://www.sephora.com/pitch-black-all-in-1-waterproof-eye-liner-P377198?skuId=1479070>> 4 pages.

* cited by examiner

QUICK RELEASE BASE AND LID ASSEMBLY CONTAINER

RELATED APPLICATIONS

This application claims priority to U.S. Provisional Application No. 62/052,104 filed Sep. 18, 2014.

TECHNOLOGY FIELD

The present application relates generally to a container with a base and lid assembly, and in particular, to a container having a quick release base and lid assembly.

BACKGROUND

Vessels or containers exist that are portable, convenient to use, and designed to contain volatile and/or aggressive products for use. These types of portable vessels usually consist of a base assembly and a lid assembly, that when assembled together provide an effective barrier for containing the volatile product. The base and/or lid are typically made of a glass, a plastic, a metal, combinations of the foregoing, or the like.

Such vessels are used in the cosmetics and personal care industries for containing a product to be applied to a body, where, as described above, the product to be applied to the body may be volatile and/or aggressive. Conventional base and lid assemblies may be opened and closed using different types of mechanisms. For example, conventional base and lid assemblies are opened and closed using rotatable thread mechanisms, snap mechanisms, and clamp mechanisms. Although portable vessels exist, there is a continuing need for more and different vessels and fastening mechanisms. Particularly, there is a continuing need for containers for cosmetics that provide a secure closure while also facilitating easy access for quick access to the product.

SUMMARY

Embodiments provide a quick release container that includes a base and a lid assembly. The base includes a base perimeter and has a well configured to hold a product. The lid assembly is configured to be removably coupled to the base and includes a lid, a depressible element and a clamping device. The lid includes: (i) an outer portion extending around a top of the base and having a height extending from the top of the base; and (ii) an inner portion extending between a perimeter of the outer portion and disposed over the well of the base. The depressible element extends between the perimeter of the outer portion, is spaced from the inner portion and is configured to move along the height of the outer portion. The clamping device is coupled to the lid and removably coupled to the base. When the depressible element is moved in a first direction toward the clamping device, a first force is applied to the clamping device causing the clamping device to disengage from the base.

According to one embodiment, the inner portion of the lid includes one or more fulcrums extending between the inner portion and the clamping device. The clamping device includes a plurality of clamping elements each having: (i) an upper arm extending between a center axis of the outer portion and the perimeter of the outer portion; and a lower arm extending substantially perpendicular to the upper arm between the upper arm and the base. When the first force is applied to the clamping device, the corresponding upper arms of the plurality of clamping elements contact the one or more fulcrums of the inner portion of the lid causing the plurality of clamping elements to flex and causing the corresponding lower arms of the plurality of clamping elements to disengage from the base.

In one aspect of an embodiment, the corresponding upper arms of the plurality of clamping elements include a sloped portion opposing the depressible element and sloping away from the depressible element as the corresponding upper arms extend from the center axis of the outer portion toward the perimeter of the outer portion.

In one embodiment, the quick release container further includes a biasing element coupled between the clamping device and the depressible element. When the depressible element is moved toward the clamping device, the first force is applied to the clamping device via the biasing element.

In an aspect of an embodiment, the biasing element is a spring.

According to one embodiment, the base and the lid are circular. In another embodiment, the base and the lid are rectangular.

In yet another embodiment, the base includes a base protruding portion extending from an edge defining an opening of the well. The corresponding lower arms of the plurality of clamping elements include one or more clamping protrusions configured to engage the protruding portion and prevent movement of the lid assembly in a second direction opposite the first direction.

Embodiments provide a quick release container that includes a base having a well configured to hold a product. The well has a neck extending from the base. The base also includes an outer base portion having an outer base perimeter and a top portion extending between the neck of the well and the outer base perimeter. The quick release container also includes a lid assembly configured to be removably coupled to the base. The lid assembly includes a lid having: (i) an outer portion disposed on the top portion of the base and having an outer perimeter extending around the top portion of the base and extending a height from the top portion of the base; (ii) an inner portion substantially perpendicular to the outer portion, extending between the outer perimeter and disposed over the well of the base, the inner portion having a plurality of fulcrums extending from the inner portion; and (iii) a gap provided between the inner portion and the outer portion. The lid assembly also includes a depressible element extending between the perimeter of the outer portion, spaced from the inner portion and configured to move along the height of the outer portion. The lid assembly further includes a clamping device coupled to the lid and removably coupled to the base. The clamping device includes a plurality of clamping elements each having: (i) an upper arm extending between a center axis of the outer portion and the perimeter of the outer portion; and (ii) a lower arm extending between the corresponding upper arm and the base. When the depressible element is moved in a first direction toward the clamping device, a first force is applied to the clamping device causing: (i) the upper arms of the clamping device to contact corresponding fulcrums, (ii) the clamping device to flex; and (iii) the lower arms to disengage from the base.

According to one embodiment, the neck includes a protruding portion extending away from the neck toward the outer portion of the lid. The lower arms of the clamping elements include one or more clamping protrusions configured to engage the protruding portion and prevent movement of the lid assembly in a second direction opposite the first direction.

According to another embodiment, the upper arm of one of the plurality of clamping elements and the upper arm of another of the plurality of clamping elements extends in opposite directions from the center axis of the outer portion.

In an aspect of an embodiment, the clamping device further includes a coupling portion extending from the center axis of the outer portion and fixedly coupled to the lid.

In one embodiment, the clamping device includes a hole disposed between the plurality of clamping elements. The depressible element includes a center portion extending from the depressible element toward the inner portion of the lid and is configured to pass through the hole when the depressible element is moved in the first direction toward the clamping device.

In another embodiment, the quick release container further includes a liner disposed between the inner portion of the lid and the neck and configured to create a complete seal. Other embodiments may include O-rings or gaskets in place of a liner.

Embodiments provide a quick release lid assembly for use with a base having a well to hold a product. The quick release lid assembly includes a lid having: (i) an outer portion configured to be disposed around a top of the base; and (ii) an inner portion extending between the outer portion and configured to be disposed over the well of the base. The quick release lid assembly also includes a depressible element extending between the perimeter of the outer portion, spaced from the inner portion and configured to move along a height of the outer portion. The quick release lid assembly further includes a clamping device coupled to the lid and configured to be removably coupled to the base. The clamping device is configured to: (i) engage with the base when the lid assembly is in a closed position; and (ii) disengage from the base when the depressible element is moved in a first direction toward the clamping device and causes a first force to be applied to the clamping device.

According to one embodiment, the inner portion of the lid includes one or more fulcrums extending between the inner portion and the clamping device. The clamping device includes a plurality of clamping elements each having: (i) an upper arm extending between a center axis of the outer portion and the perimeter of the outer portion; and (ii) a lower arm configured to extend substantially perpendicular to the upper arm between the upper arm and the base. When the first force is applied to the clamping device, the corresponding upper arms of the plurality of clamping elements are configured to contact the one or more fulcrums of the inner portion of the lid and cause the plurality of clamping elements to flex and cause the corresponding lower arms of the plurality of clamping elements to disengage from the base.

According to another embodiment, the corresponding upper arms of the plurality of clamping elements include a sloped portion opposing the depressible element and sloping away from the depressible element as the corresponding upper arms extend from the center axis of the outer portion toward the perimeter of the outer portion.

In yet another embodiment, the quick release lid assembly further includes a biasing element coupled between the clamping device and the depressible element. When the depressible element is moved toward the clamping device, the first force is applied to the clamping device via the biasing element.

In an aspect of an embodiment, the biasing element is a spring.

BRIEF DESCRIPTION OF THE DRAWINGS

The foregoing and other aspects of the container having a quick release base and lid assembly are best understood from the following detailed description when read in connection with the accompanying drawings. There is shown in the drawings embodiments that are presently preferred, it being understood, however, that the disclosure is not limited to the specific instrumentalities disclosed. Included in the drawings are the following Figures.

DETAILED DESCRIPTION OF EXEMPLARY EMBODIMENTS

Figure 1A:
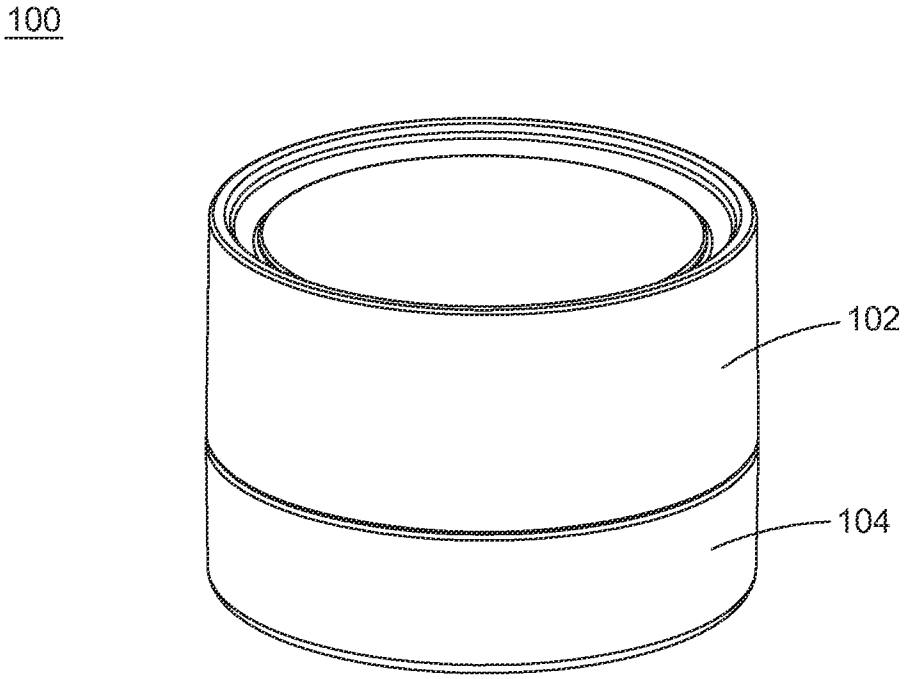
FIG. 1A is a perspective view of a quick release container in a closed position according to embodiments disclosed herein.
Figure 1B:
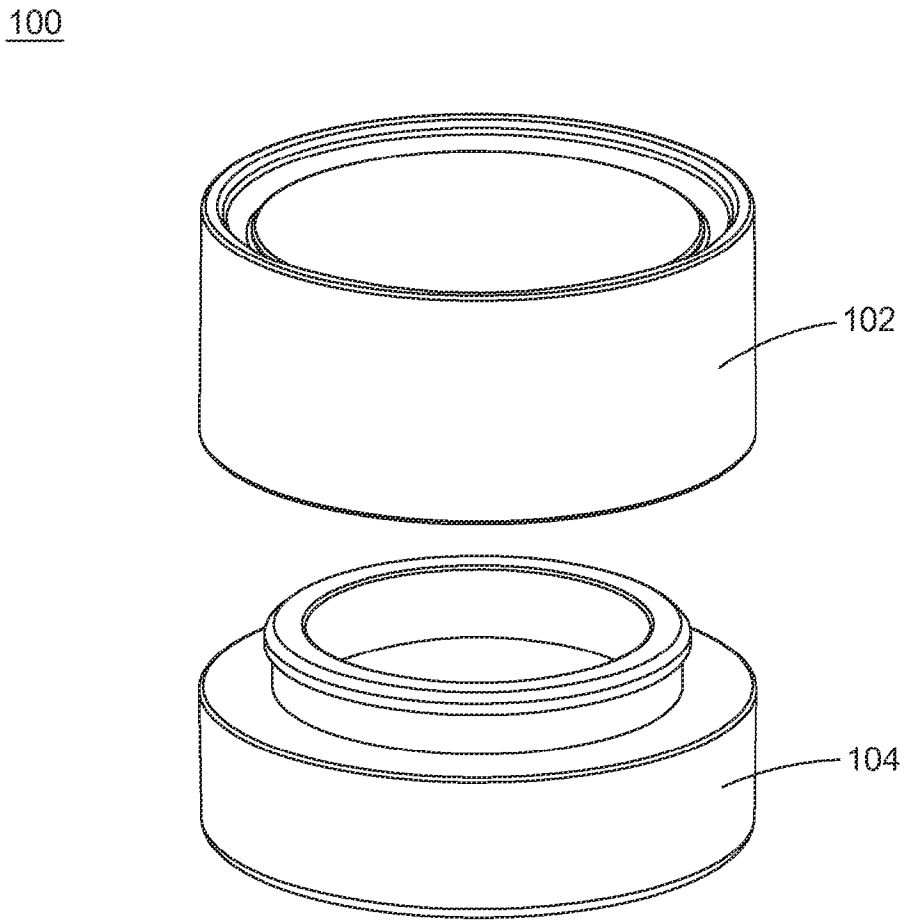
FIG. 1B is a perspective view of the quick release container shown in FIG. 1A with the lid assembly removed from the base according to embodiments disclosed herein.

FIG. 1A is a perspective view of a quick release container 100 in a closed position according to embodiments disclosed herein. As shown in FIG. 1A, quick release container 100 may include a lid assembly 102 and a base 104. FIG. 1B is a perspective view of a quick release container 100 with the lid assembly 102 removed from the base 104 according to embodiments disclosed herein. The size and shape of the quick release container 100 and each portion of the quick release container 100 shown in FIG. 1A and FIG. 1B is merely exemplary. Embodiments may include quick release containers having other shapes and sizes.

Figure 2:
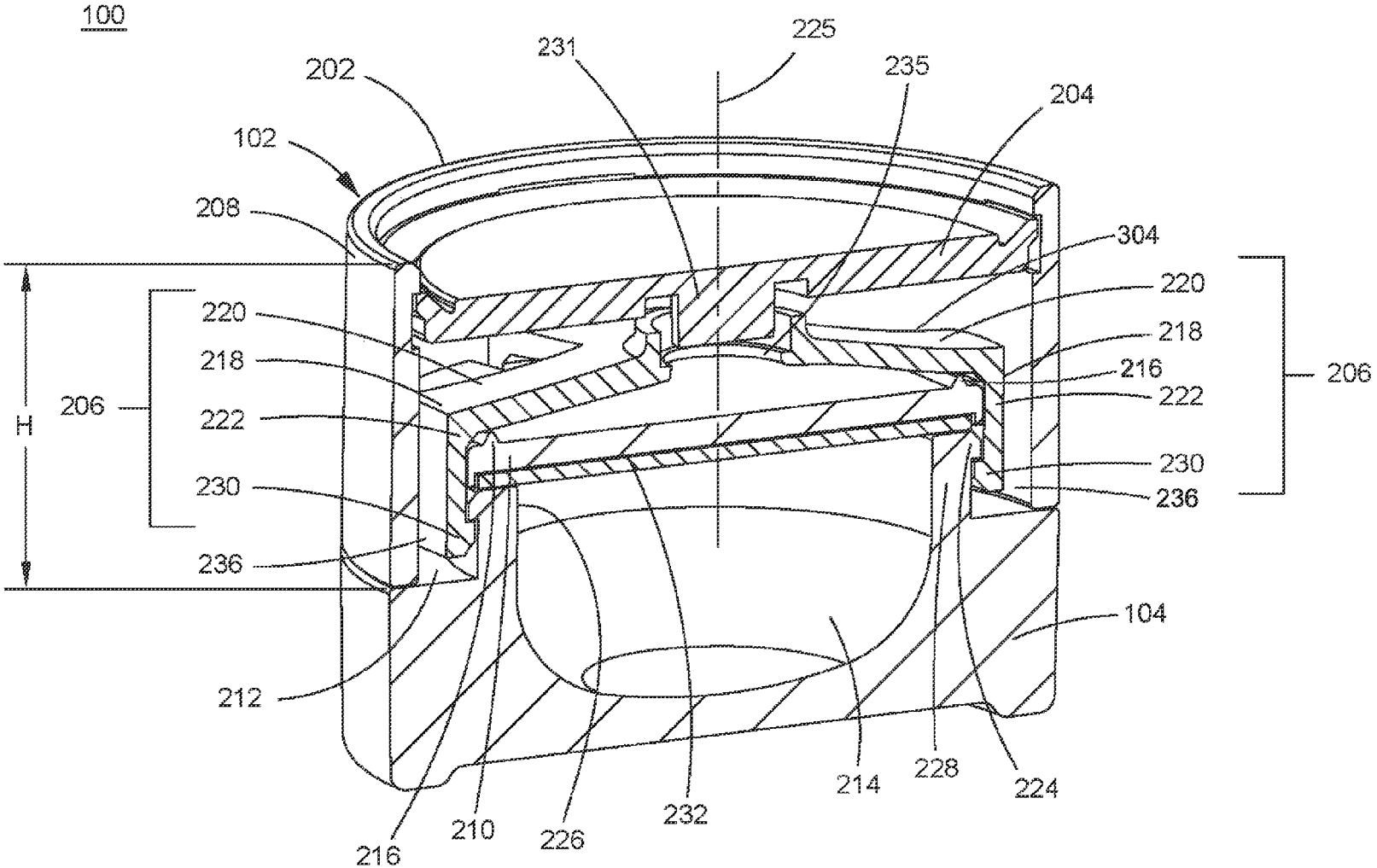
FIG. 2 is a cross-sectional perspective view of the exemplary quick release container in a closed position according to embodiments disclosed herein.
Figure 3:
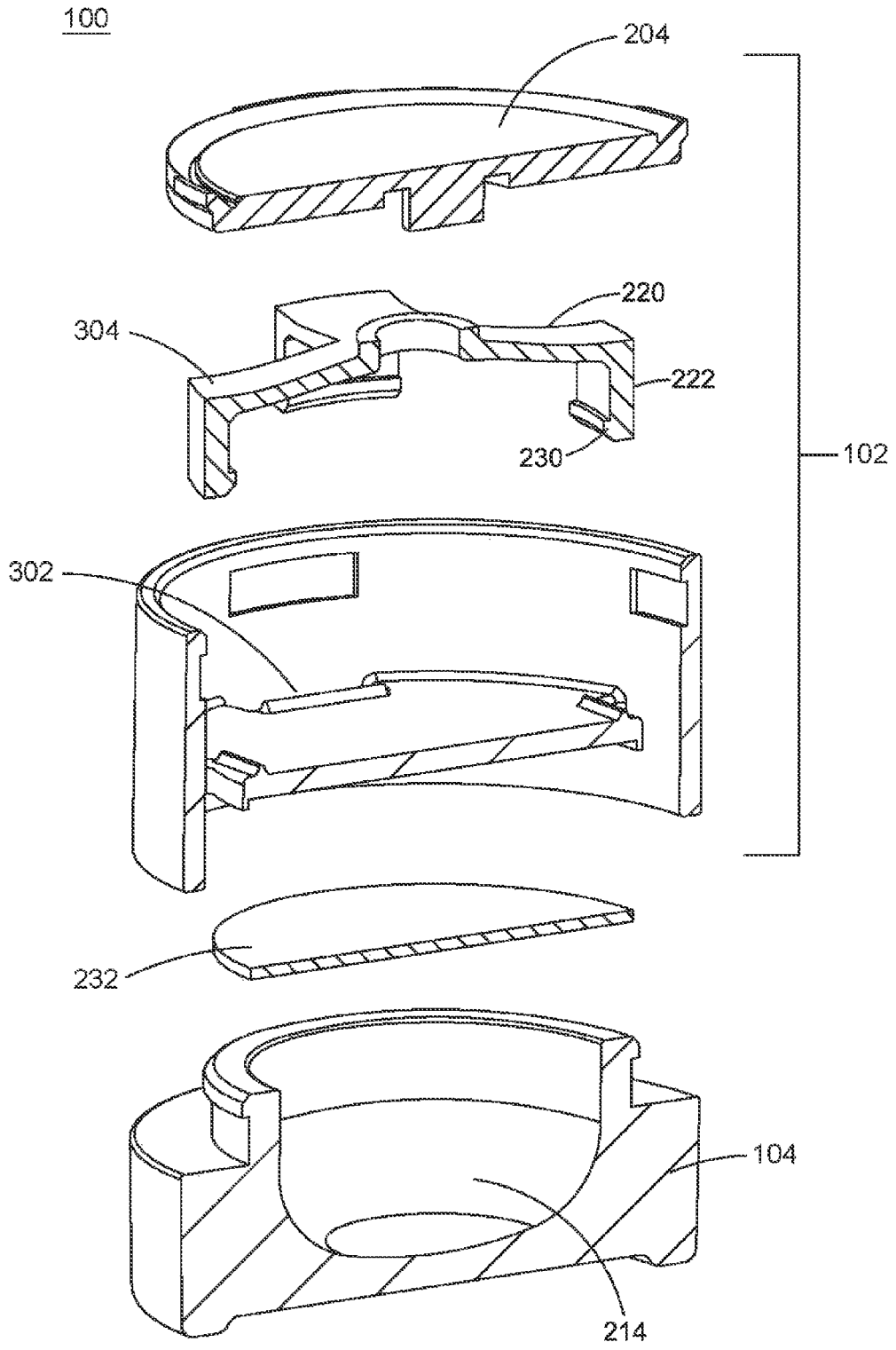
FIG. 3 is an exploded view of an exemplary quick release container according to embodiments disclosed herein.

FIG. 2 is a cross-sectional perspective view of exemplary quick release container 100 in a closed position according to embodiments disclosed herein. FIG. 3 is an exploded cross sectional view of an exemplary quick release container 100 according to embodiments disclosed herein. Retelling to FIG. 2 and FIG. 3, base 104 may include a well 214 configured to hold a product (not shown). Exemplary quick release containers may be used to hold any type of product, but may be particularly well suited for cosmetics that may include, but are not limited to loose powders (e.g., for eye, cheek, face, and the like), creams skincare, eye, foundation, and the like), sunscreen, hot pour products (e.g., lipsticks, glosses, and the like), touchup, spot cover, baked powders, moisturizers, hair creams, gels, serums, and the like.

Lid assembly 102 may include a lid 202, a depressible element 204 and a clamping device 206. Lid 202 may include an outer portion 208 extending around a top 212 of the base 104 and have a height H extending from the top 212 of the base 104. Lid 202 may also include an inner portion 210 extending between the perimeter of the outer portion 208 and disposed over the well 214 of the base 104. The depressible element 204 may extent between the perimeter of the outer portion 208 and is spaced from the inner portion 210.

As shown in FIG. 2 and FIG. 3, the inner portion 210 of the lid 202 includes fulcrums 216. As shown in FIG. 2, fulcrums 216 may extend between the inner portion 210 and the clamping device 206. The location, number and shape of fulcrums shown in FIG. 2 and FIG. 3 is exemplary. Embodiments may include any number of fulcrums having shapes other than the shape of the fulcrums 216 shown in FIG. 2 and FIG. 3. For example, embodiments may include a continuous fulcrum extending around a top of inner portion of a lid.

The clamping device 206 may be fixedly coupled to the outer portion 208 of the lid 202. For example, as shown in FIG. 2 and FIG. 3, the clamping device 206 may include a coupling portion 304 extending from the center axis 225 of the outer portion 208 and fixedly coupled to the outer portion 208 of the lid 202 at coupling area 302. The clamping device 206 may include a plurality of clamping elements 218. The number, shape and location of clamping elements 218 shown in FIG. 2 is exemplary. Embodiments may include clamping any number of clamping elements having shapes and location different from those shown in FIG. 2 and FIG. 3. As shown in FIG. 2 and FIG. 3, each clamping element 218 may include a first portion or upper arm 220 extending between the center axis 225 and the perimeter of the outer portion 208.

Each clamping element 218 may also include a second portion or lower arm 222 extending substantially perpendicular to the upper arm 220 and between the upper arm 220 and the base 104. As shown in FIG. 2 and FIG. 3, each lower arm 222 may extend from each corresponding upper arm 220 within gaps 236 provided between the inner portion 210 and the outer portion 208 of the lid 202.

As shown in FIG. 2, an upper arm 220 of each clamping element 218 my slope away from the depressible element 204 as the corresponding upper arms 220 extend from the center axis 225 toward the perimeter of the outer portion 208. As further shown in FIG. 2 and FIG. 3, the amount of slope of each clamping element 218 may change as the corresponding upper arm 220 extends from the center axis 225 toward the perimeter of the outer portion 208. The shape of the corresponding upper arms 220 shown in FIG. 2 and FIG. 3 are exemplary. Embodiments may include clamping elements having shapes with slopes that are different than the clamping elements 218. Embodiments may include clamping elements having any amount of slope, including portions with no slope.

As shown in the embodiment shown at FIG. 2, the clamping device 206 may include a hole 235 disposed between the clamping elements 218. The depressible element 204 may include a center portion 231 extending from the depressible element 204 toward the inner portion 210 of the lid 202 and may be disposed within the hole 235.

The base 104 may include a base protruding portion 224 extending from a neck 228 having an inner edge 226 defining an opening of the well 214. As shown in FIG. 2, the lower arms 222 of each clamping element 218 include a clamping protrusion 230 configured to engage the base protruding portion 224 when the container 100 is in a closed position.

As shown in the embodiment shown at FIG. 2 and FIG. 3, the quick release container 100 may include a liner 232 disposed between the inner portion 210 of the lid 202 and the neck 228 and configured to cover the well 214 of the base 104. The liner 232 may be configured to create a complete seal between the lib assembly 102 and the base 104. In some embodiments, liner 232 may be a part of lid assembly 102 and may be attached to inner portion 210. Accordingly, liner 232 may be removed from the base 104 when the lid assembly 102 is removed from the base 104. In other embodiments, liner 232 may be separate from lid assembly 102 and may be removed from the base 104 independent of lid assembly 102. On other embodiments, an o-ring or gasket may be used in place of a liner 232.

Figure 4A:
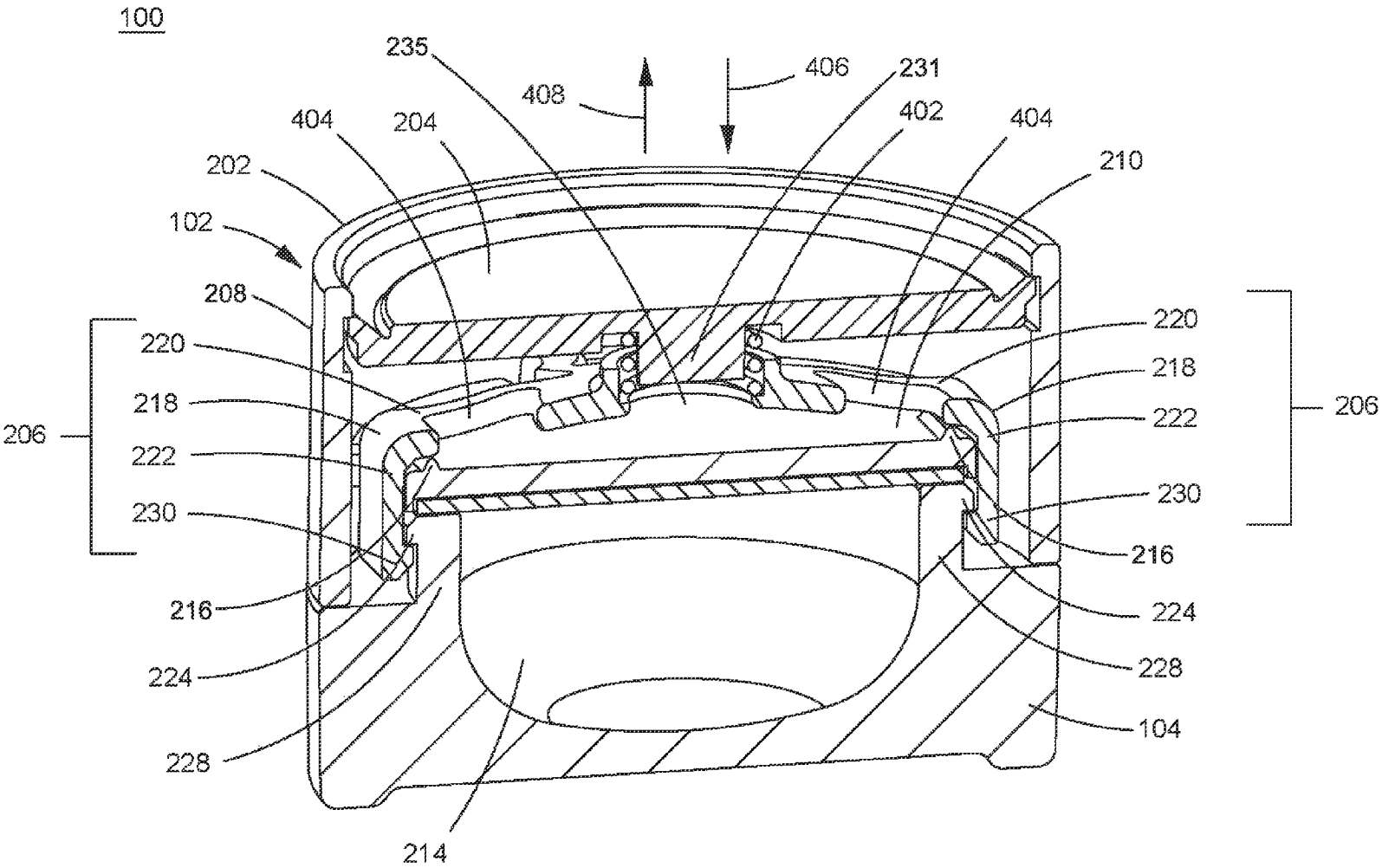
FIG. 4A through FIG. 4D are cross sectional views of an exemplary quick release container illustrating the container at different states according to embodiments disclosed herein.
Figure 4B:
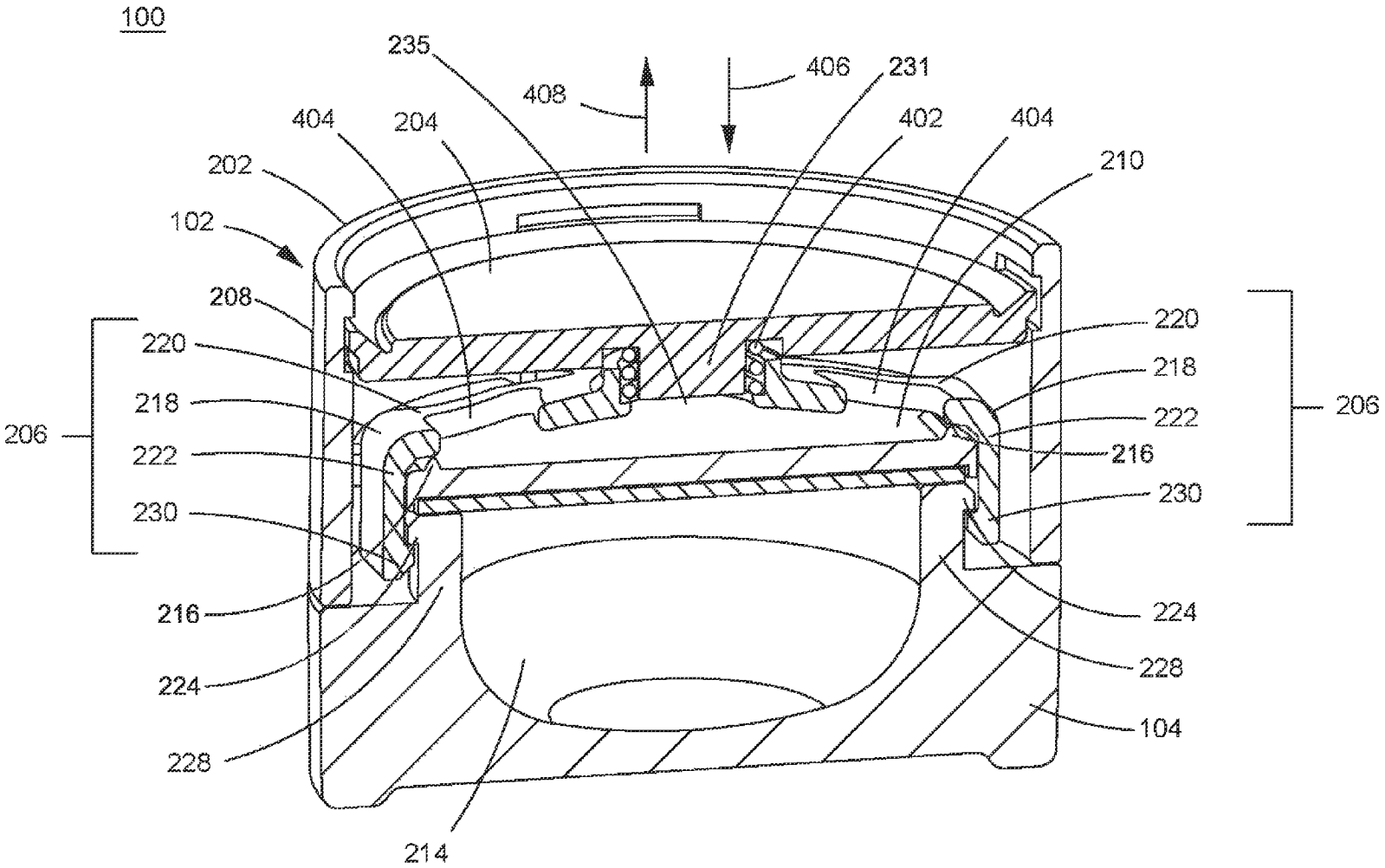
Figure 4C:
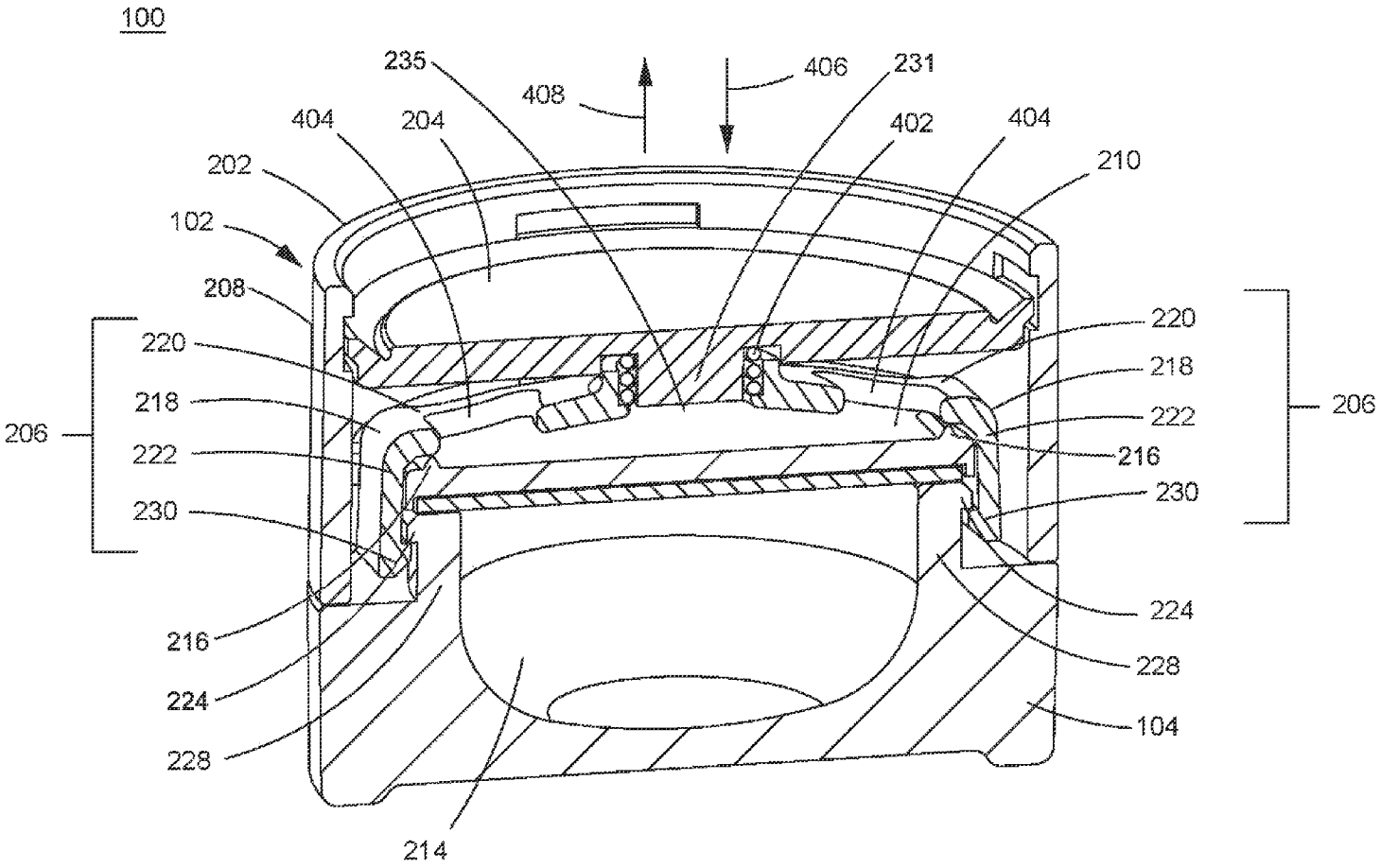
Figure 4D:
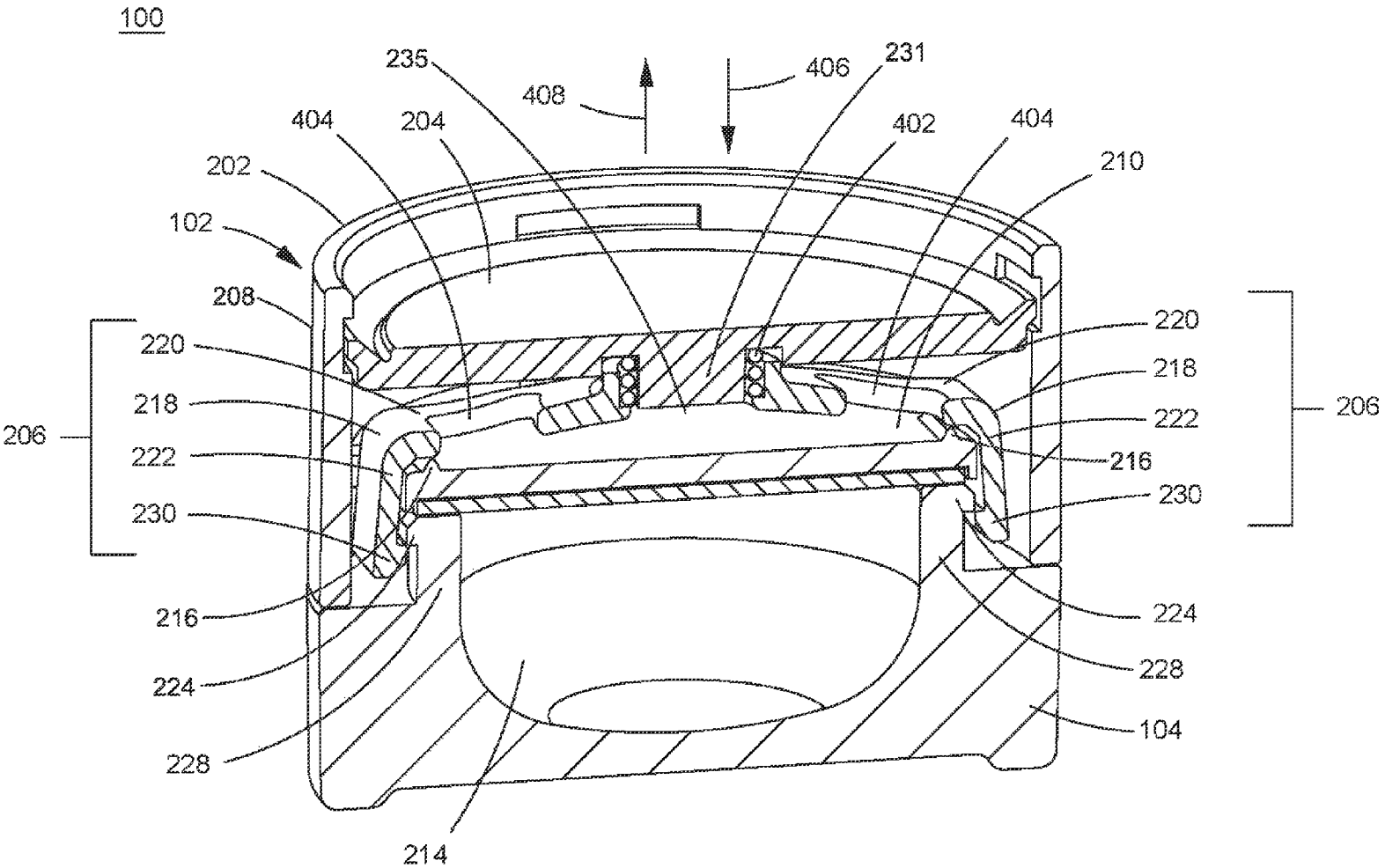

Movement between various states of the exemplary quick release container 100 will now be described with reference to FIG. 4A through FIG. 4D. FIG. 4A through FIG. 4D are cross sectional views of an exemplary quick release container illustrating the container at different states according to embodiments disclosed herein. FIG. 4A is a cross sectional view of exemplary quick release container 100 in a closed position. FIG. 4B is a cross sectional view of the exemplary quick release container 100 in the closed position with spring 402 compressed. FIG. 4C is a cross sectional view of the exemplary quick release container 100 in the closed position with clamping protrusions 230 becoming disengaged from the base protruding portion 224. FIG. 4D is across sectional view of the exemplary quick release container 100 in the closed position with clamping protrusions 230 disengaged from the base protruding portion 224.

In the embodiment shown in FIG. 4A through FIG. 4D, a biasing element such as spring 402 may be coupled between the depressible element 204 and the clamping device 206. Further, the upper arms 220 of the clamping elements 218 in the embodiment shown at FIG. 4A through FIG. 4D are shaped differently than the upper arms 220 of the clamping elements 218 in the embodiment shown at FIG. 2 and FIG. 3. For example, the upper arms 220 of the clamping elements 218 in the embodiment shown at FIG. 4A through FIG. 4D include recesses 404. The shape of the recesses shown in FIG. 4A through FIG. 4D are exemplary. Embodiments may include recesses having sizes different from those shown in FIG. 4A through FIG. 4D.

When clamping protrusion 230 is engaged with the base protruding portion 224 as shown in FIG. 4A, clamping protrusion 230 prevents movement of the lid assembly in a second direction indicated by arrow 408 opposite the first direction, indicated by arrow 406. Depressible element 204 may be moved (e.g., pressed by a user not shown) from its position shown in FIG. 4A toward the clamping device 206 in the first direction arrow 406. When depressible element 204 is moved in the first direction 406, center portion 231 may pass through the hole 235 and the spring 402 begins to compress, as shown in FIG. 4B. Further, when depressible element 204 is moved in the first direction 406, a force may be applied via the spring 402 by the depressible element 204 to the clamping device 206. In response, the corresponding upper arms 220 of the clamping elements 218 contact fulcrums 216 causing the clamping elements 218 to flex towards outer portion 208 and the clamping protrusions 230 begin to disengage from the base protruding portion 224, as shown in FIG. 4C. As shown in FIG. 4D, the force applied via the spring 402 by the depressible element 204 cause the clamping elements 218 to continue to flex and the clamping protrusions 230 to disengage from the base protruding portion 224. The lid assembly 102 may then be removed (e.g., by a user not shown) from the base 104.

In some embodiments, quick release containers may include one or more additional biasing elements (not shown) to facilitate removal of lid assemblies 102 from bases 104. For example, a second biasing element (not shown) may be coupled between the lower arms 222 of clamping device 206 and the base 104 or between the clamping device 206 and inner portions 210 of lids 202. Accordingly, when the clamping protrusions 230 disengage from the base 104, the second biasing element may apply a second force causing the clamping device 206 to move in the second direction 408 opposite the first direction 406 to facilitate the movement of the lid assembly 102 from the base 104.

In the embodiment shown in FIG. 4A through FIG. 4D, the clamping protrusions 230 disengage from base protruding portion 224 when the force is applied by the depressible element 204 to the clamping device 206 via spring 402. In some embodiments, however, such as for example as shown in FIG. 2 and FIG. 3, the depressible element 204 may contact the clamping device 206 directly when the depressible element 204 is moved toward the clamping device 206. Accordingly, in the embodiment shown in FIG. 2 and FIG. 3, the clamping protrusions 230 may disengage from base protruding portion 224 when the force is applied by the depressible element 204 directly to the clamping device 206.

Figure 5A:
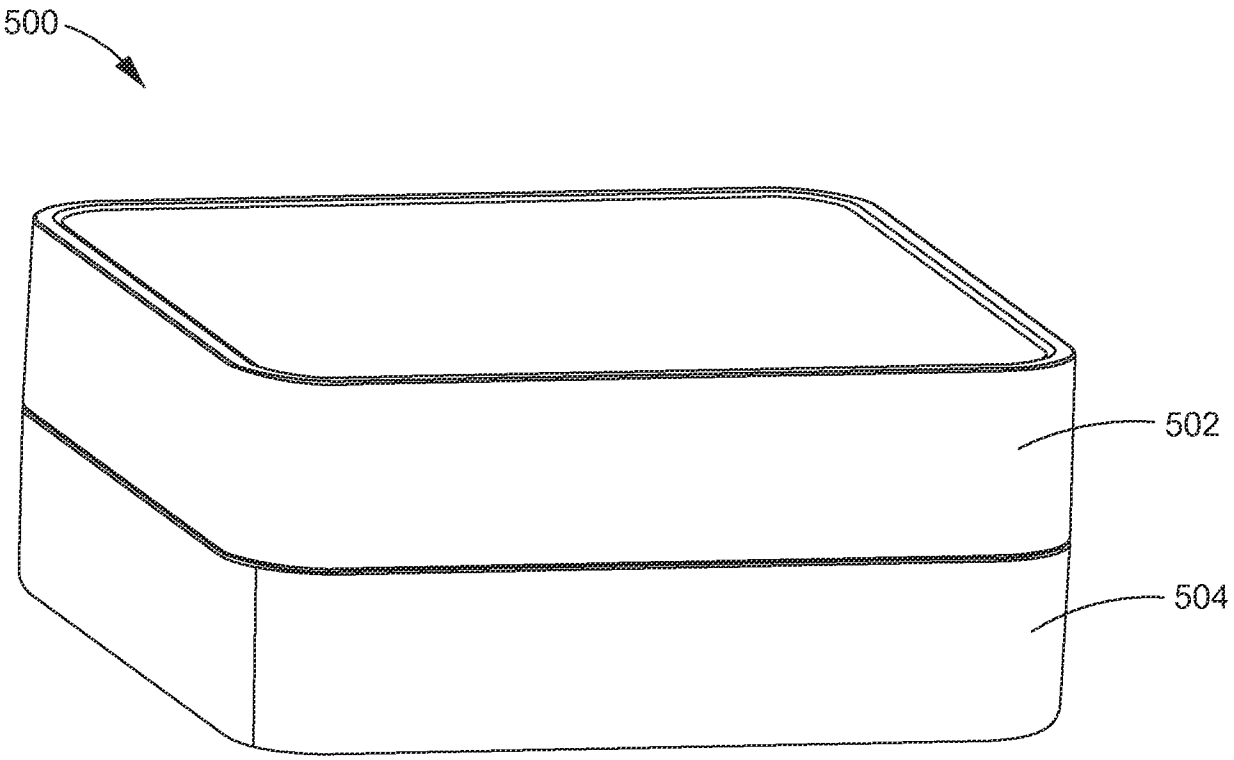
FIG. 5A is a perspective view of a rectangular quick release container in a closed position according to embodiments disclosed herein.
Figure 5B:
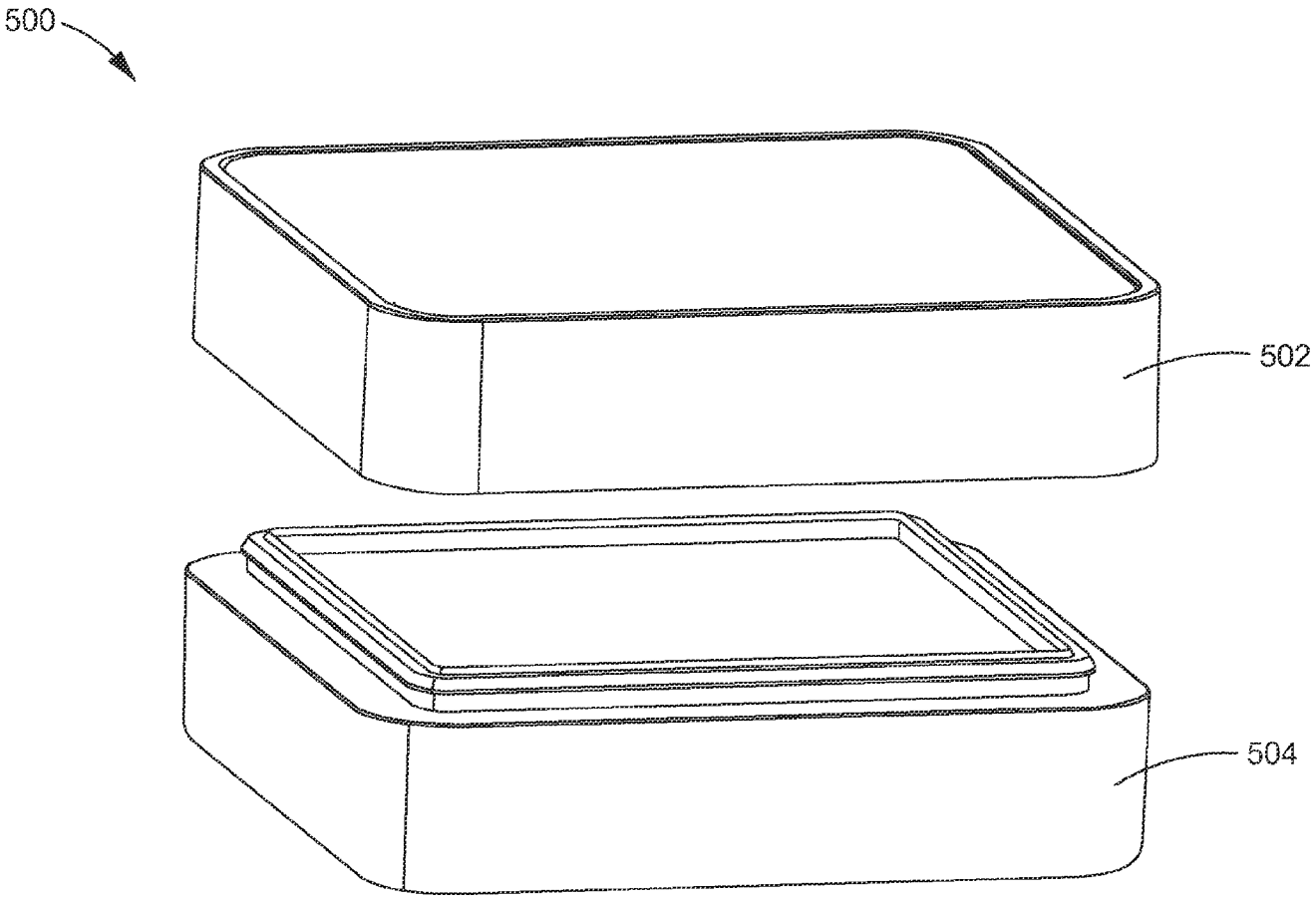
FIG. 5B is a perspective view of the rectangular quick release container shown in FIG. 5A with the lid assembly removed from the base according to embodiments disclosed herein.

The quick release container 100 shown in FIG. 1A through FIG. 4D includes a circular circumferential perimeter. Quick release containers may, however, be shaped other than the quick release container 100. For example, quick release containers may be rectangular shaped, square shaped, oval shaped or any other shape. FIG. 5A is a perspective view of a rectangular quick release container in a closed position according to embodiments disclosed herein. As shown in FIG. 5A, quick release container 500 may include a rectangular lid assembly 502 and a rectangular base 504. FIG. 5B is a perspective view of the rectangular quick release container shown in FIG. 5A with the lid assembly 502 removed from the base 504 according to embodiments disclosed herein.

Figure 6A:
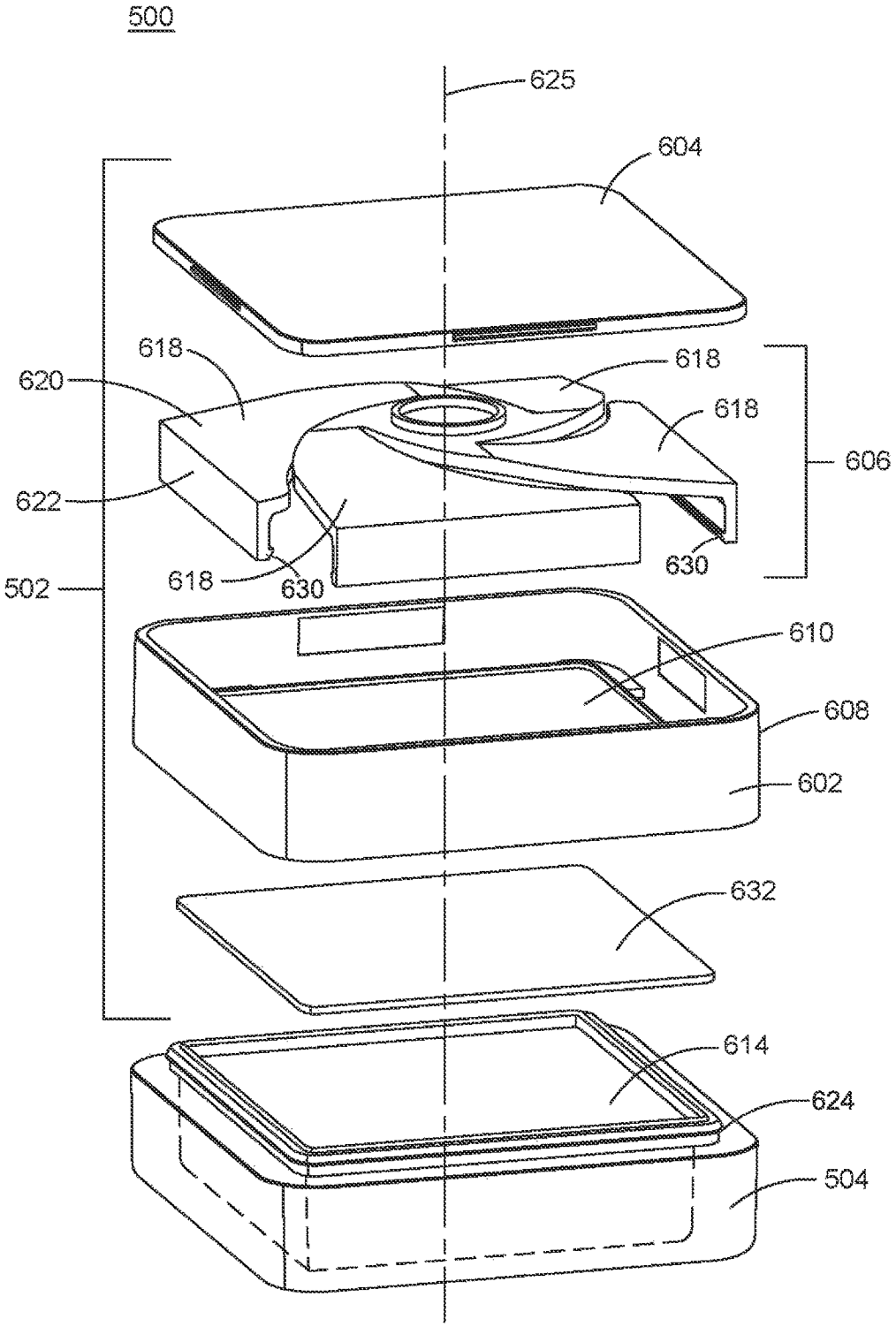
FIG. 6A is an exploded view of the exemplary rectangular quick release container shown in FIG. 5A according to embodiments disclosed herein.
Figure 6B:
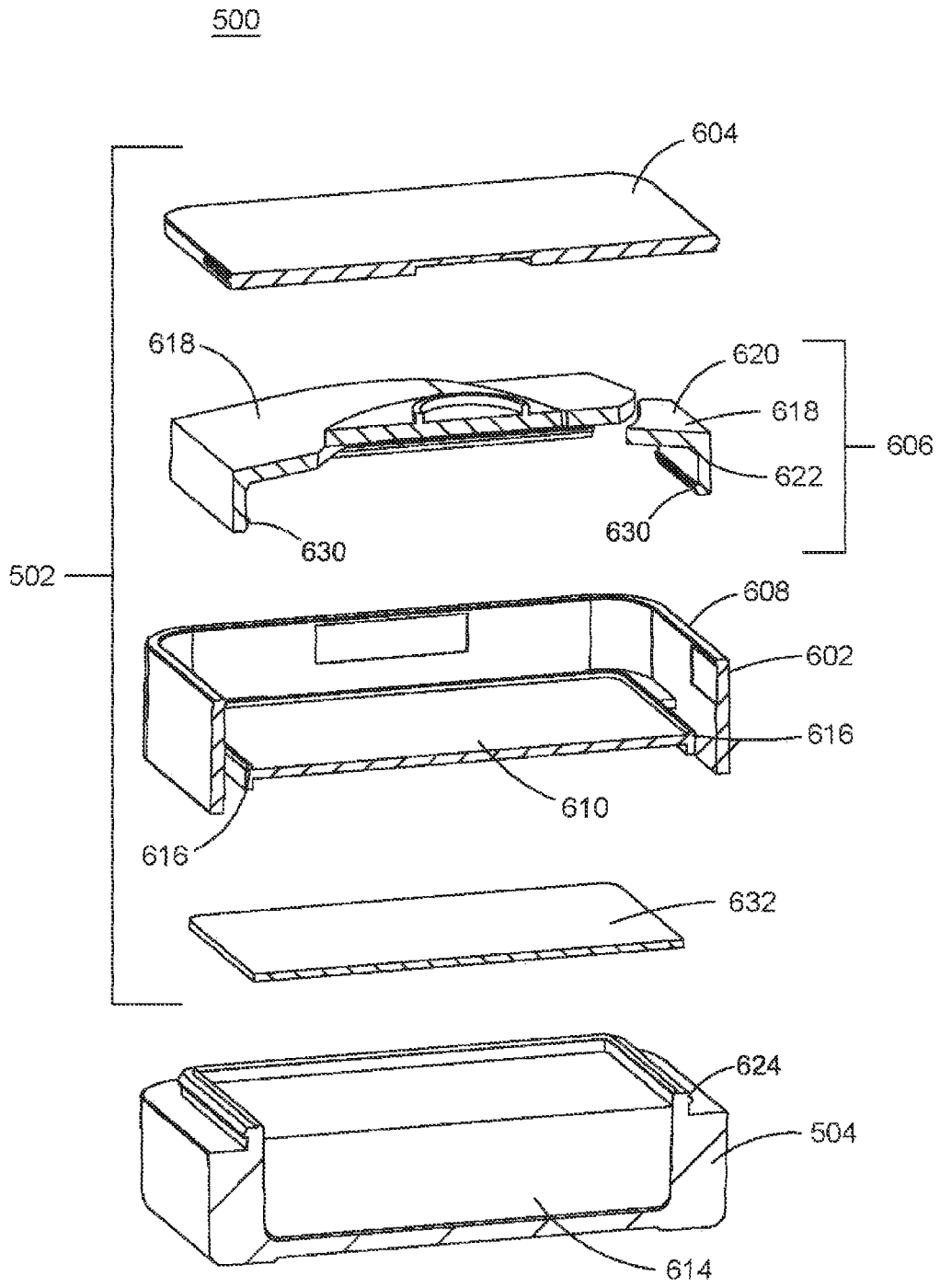
FIG. 6B is a cross sectional exploded view of the exemplary rectangular quick release container shown in FIG. 5A according to embodiments disclosed herein.
Figure 7A:
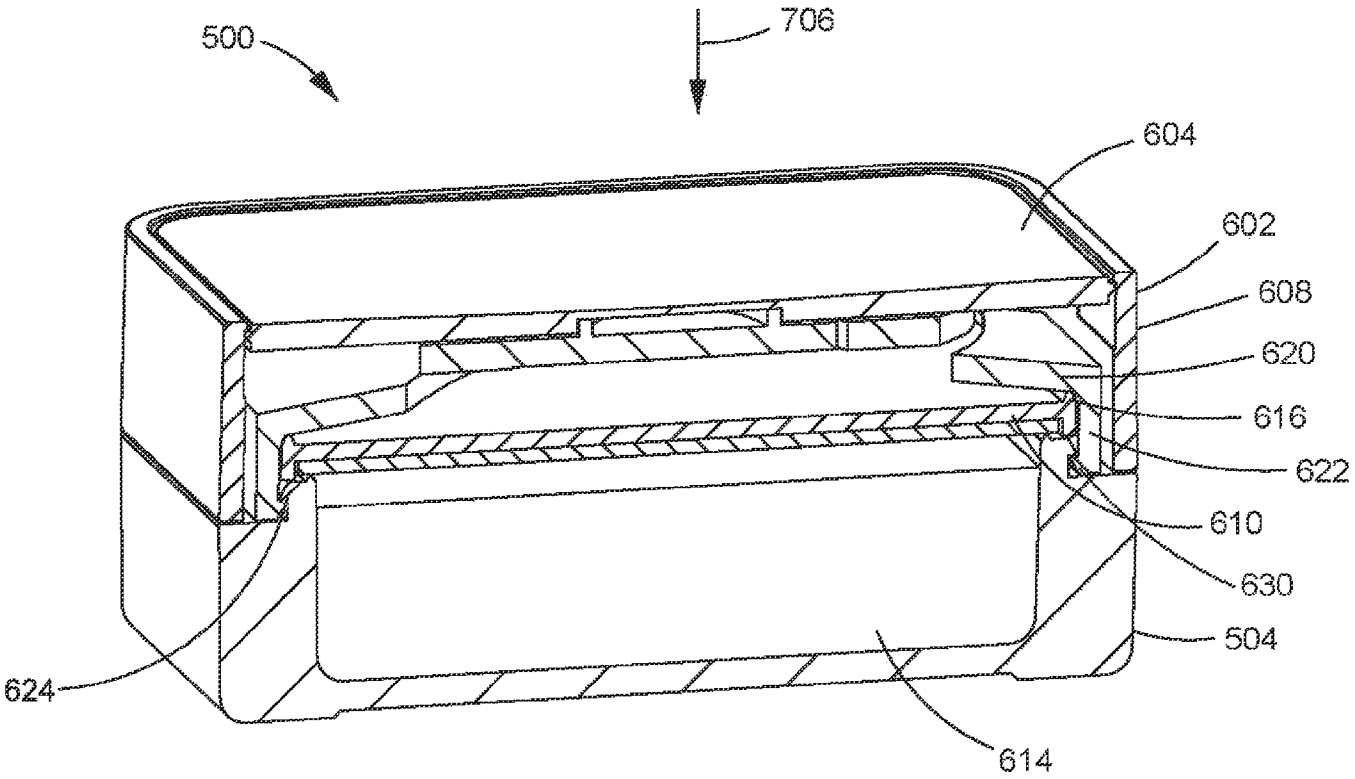
FIG. 7A through FIG. 7C are cross sectional views of an exemplary rectangular quick release container at different states according to embodiments disclosed herein.
Figure 7B:
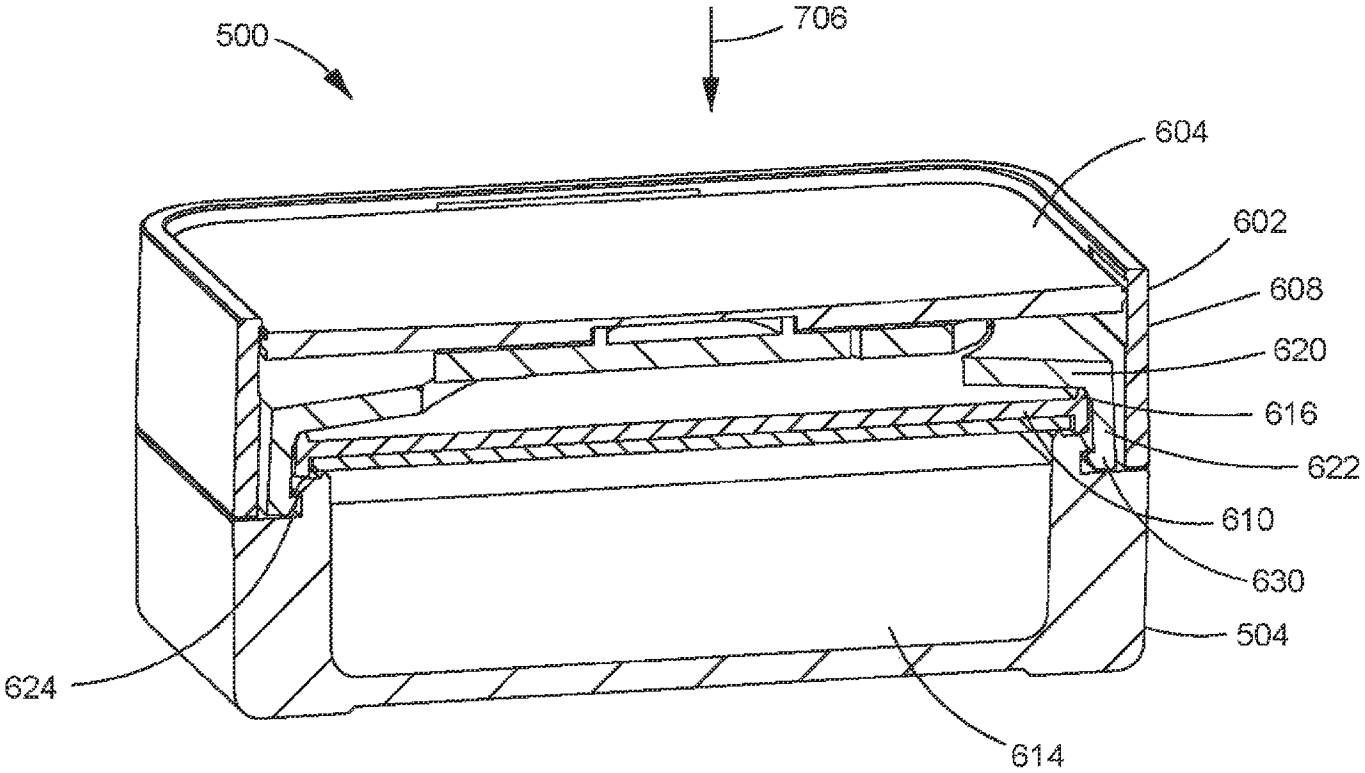
Figure 7C:
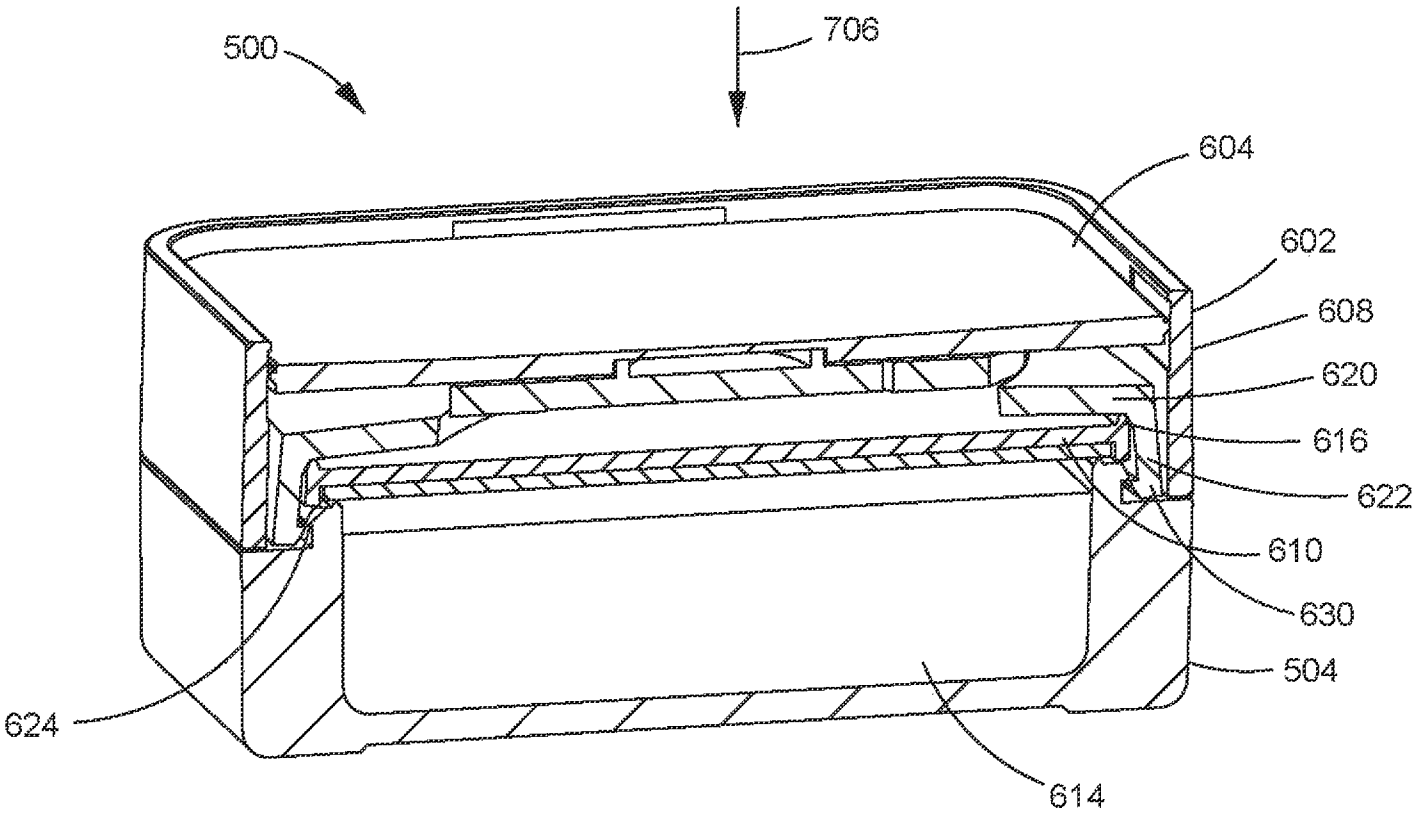

FIG. 6A is an exploded view of the exemplary rectangular quick release container shown in FIG. 5A according to embodiments disclosed herein. FIG. 6B is a cross sectional exploded view of the exemplary rectangular quick release container shown in FIG. 5A according to embodiments disclosed herein. FIG. 7A through FIG. 7C are cross sectional views of an exemplary rectangular quick release container 500 at different states according to embodiments disclosed herein. Referring generally to FIG. 6A through 7C, lid assembly 502 may include a lid 602, a depressible element 604 and a clamping device 606. Lid 602 may include an outer portion 608 and an inner portion 610.

The clamping device 606 may include four clamping elements 618. Each clamping element 618 may include a first portion or upper arm 620 extending between the center axis 625 and the perimeter of the outer portion 608. The number, shape and location of clamping elements 618 is exemplary. Embodiments may include clamping any number of clamping elements having shapes and location different from those shown in FIG. 6A through 7C. Each clamping element 618 may also include a second portion or lower arm 622 extending substantially perpendicular to the upper arm 620 and between the upper arm 620 and the base 504.

The base 504 may include a base protruding portion 624 and the lower arms 622 of each clamping element 618 may include a clamping protrusion 630 configured to engage the base protruding portion 624 when the container 500 is in a closed position. The exemplary rectangular quick release container 500 may also include a liner 632 configured to cover the well 614 of the base 504.

Referring to FIG. 7A through 7C, depressible element 604 may be moved (e.g., pressed by a user not shown) from its position shown in FIG. 7A toward the clamping device 606 in the first direction arrow 706. When depressible element 604 is moved in the first direction 706, a force may be applied by the depressible element 604 to the clamping device 606. In response, the corresponding upper arms 620 of the clamping elements 618 contact fulcrums 616 causing the clamping elements 618 to flex and the clamping protrusions 630 begin to disengage from the base protruding portion 624, as shown in FIG. 7B. As shown in FIG. 7C, the force applied by the depressible element 604 cause the clamping elements 618 to continue to flex and the clamping protrusions 630 to disengage from the base protruding portion 624. The lid assembly 502 may then be removed (e.g., by a user not shown) from the base 504.

Figure 8A:
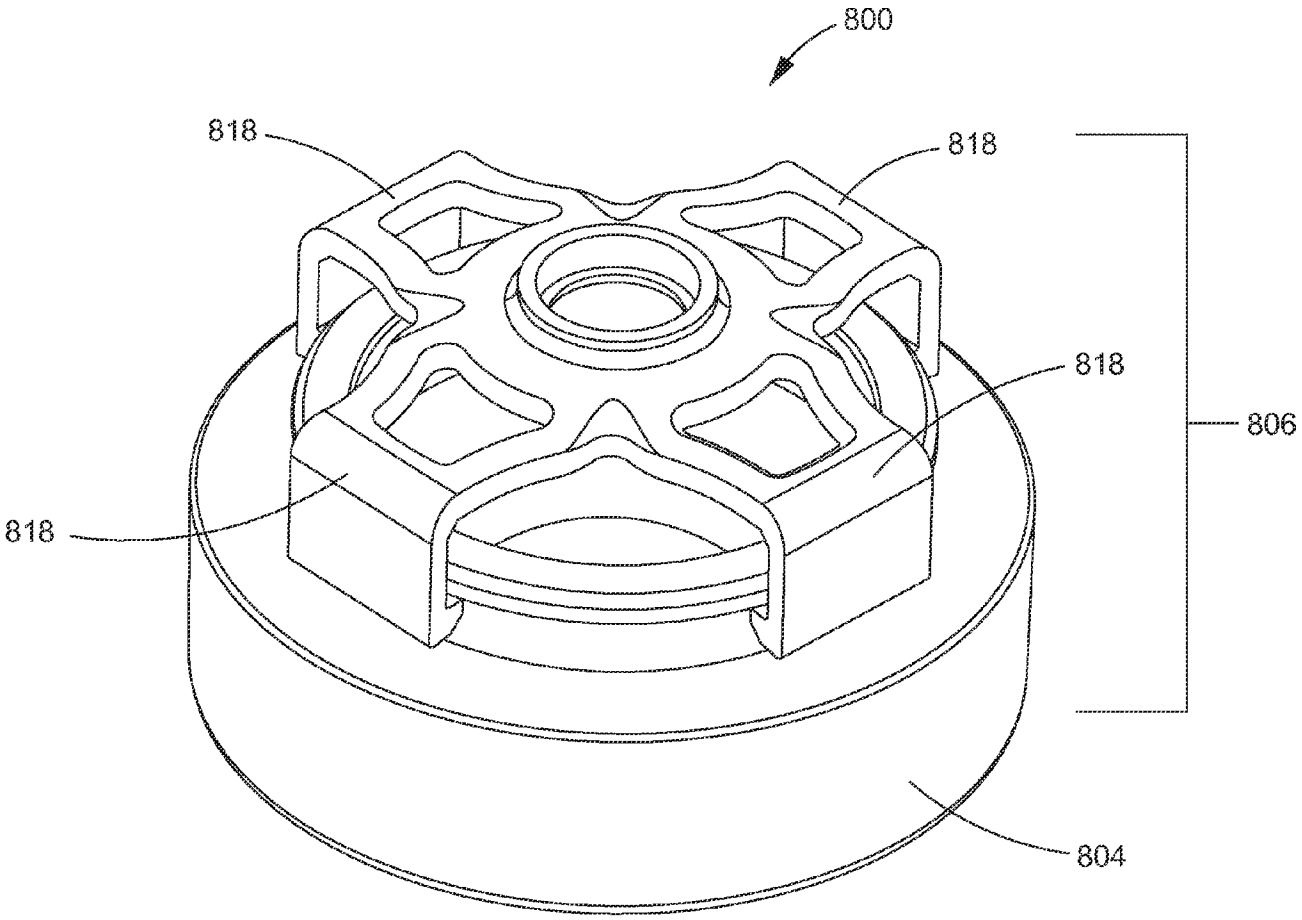
FIG. 8A is a perspective view of a quick release container with the lid removed illustrating an exemplary clamping device having four clamping elements according to embodiments disclosed herein.
Figure 8B:
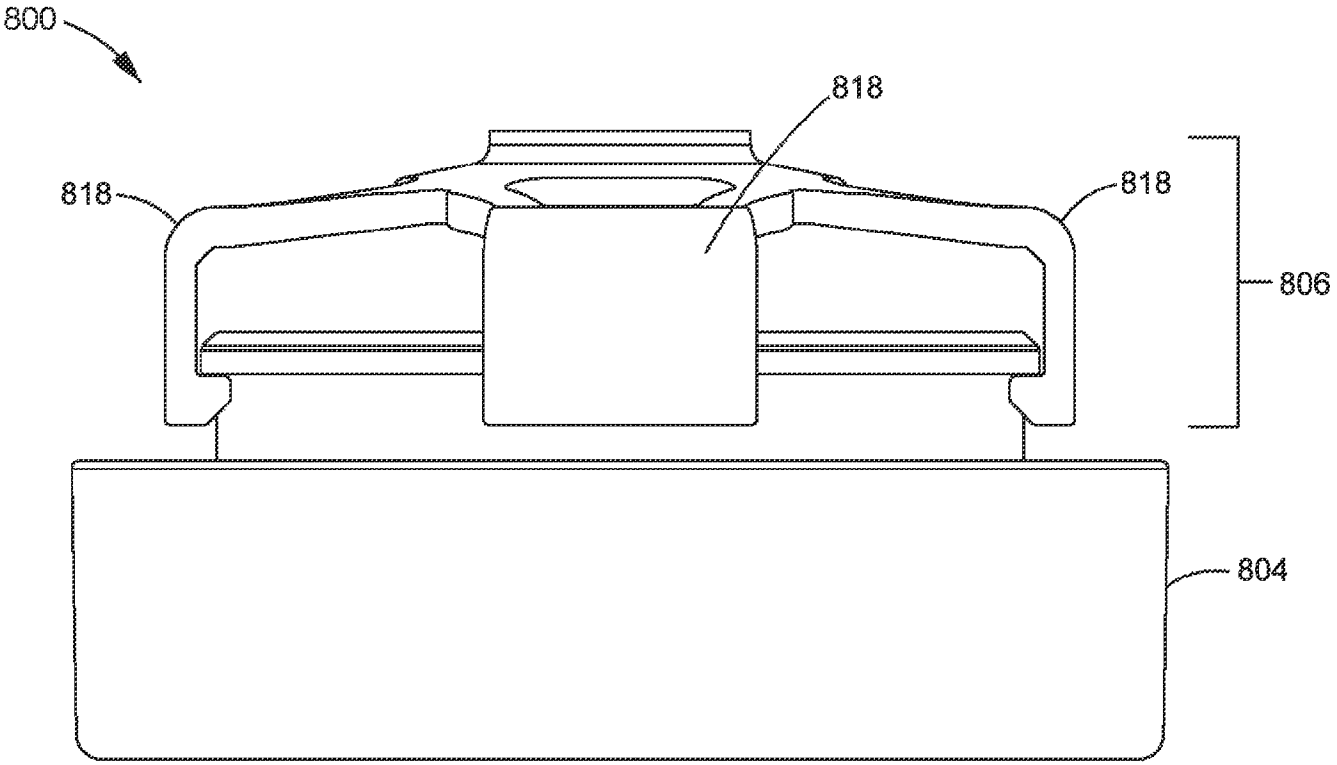
FIG. 8B is a side view of the quick release container shown in FIG. 8A.

FIG. 8A and FIG. 8B show another configuration of an exemplary clamping device 806 coupled to a base 804 of a quick release container 800. FIG. 8A is a perspective view of a quick release container 800 with the lid removed to illustrate an exemplary clamping device 806 having four clamping elements 818 according to embodiments disclosed herein. FIG. 8B is a side view of the quick release container shown in FIG. 8A.

The size, shape, and dimensions of the exemplary quick release containers shown throughout are merely exemplary. For example, exemplary circular quick release containers may include outer circumferential perimeters ranging from about 30 mm to about 300 mm. Exemplary circular quick release containers may also include bases having opening circumferential perimeters ranging from about 25 mm to about 250 mm. Exemplary circular jar and lid assemblies may further include heights ranging from about 8 mm to about 80 mm, and in some embodiments, about 10 mm to about 60 mm.

In some embodiments, the exemplary circular quick release containers may include perimeter diameters ranging from about 10 mm to about 150 mm. In some embodiments, the exemplary circular quick release containers may include opening diameters ranging from about 8 mm to about 130 mm.

Exemplary rectangular quick release containers may include outer perimeters ranging from about 40 mm to about 400 mm. Exemplary rectangular quick release containers may also include bases having opening perimeters ranging from about 32 mm to about 320 mm. Exemplary rectangular jar and lid assemblies may further include heights ranging from about 10 mm to about 60 mm. Exemplary rectangular quick release containers may include lengths and widths each independently ranging from about 10 mm to about 150 mm.

Although the invention has been described with reference to exemplary embodiments, it is not limited thereto. Those skilled in the art will appreciate that numerous changes and modifications may be made to the preferred embodiments of the invention and that such changes and modifications may be made without departing from the true spirit of the invention. It is therefore intended that the appended claims be construed to cover all such equivalent variations as fall within the true spirit and scope of the invention.

What is claimed is:

1. A quick release container comprising:

a base comprising a base perimeter and having a well configured to hold a product; and a lid assembly configured to be removably coupled to the base, the lid assembly comprising:

a lid having: (i) an outer portion extending around a top of the base and having a height extending from the top of the base; and (ii) an inner portion extending between a perimeter of the outer portion and disposed over the well of the base;

a depressible element extending between the perimeter of the outer portion, spaced from the inner portion and configured to move along the height of the outer portion; and a clamping device coupled to the lid and removably coupled to the base, the clamping device including a plurality of clamping elements;

wherein the inner portion of the lid comprises one or more fulcrums extending between the inner portion and the clamping device, wherein when the depressible element is moved in a first direction toward the clamping device, a first force is applied to the clamping device causing the plurality of clamping elements to contact the one or more fulcrums, causing the plurality of clamping elements to flex, and causing the clamping device to disengage from the base.

2. The quick release container according to claim 1, the plurality of clamping elements each having: (i) an upper arm extending between a center axis of the outer portion and the perimeter of the outer portion; and (ii) a lower arm extending substantially perpendicular to the upper arm between the upper arm and the base, wherein when the first force is applied to the clamping device, the corresponding upper arms of the plurality of clamping elements contact the one or more fulcrums of the inner portion of the lid causing the plurality of clamping elements to flex and causing the corresponding lower arms of the plurality of clamping elements to disengage from the base.

3. The quick release container according to claim 2, wherein the corresponding upper arms of the plurality of clamping elements comprise a sloped portion opposing the depressible element and sloping away from the depressible element as the corresponding upper arms extend from the center axis of the outer portion toward the perimeter of the outer portion.

4. The quick release container according to claim 1, further comprising:

a biasing element coupled between the clamping device and the depressible element, wherein, when the depressible element is moved toward the clamping device, the first force is applied to the clamping device via the biasing element.

5. The quick release container according to claim 4, wherein the biasing element is a spring.

6. The quick release container according to claim 1, wherein the base and the lid are circular.

7. The quick release container according to claim 1, wherein the base and the lid are rectangular.

8. The quick release container according to claim 2, wherein the base comprises a base protruding portion extending from an edge defining an opening of the well, the corresponding lower arms of the plurality of clamping elements comprise one or more clamping protrusions configured to engage the base protruding portion and prevent movement of the lid assembly in a second direction opposite the first direction.

9. A quick release container comprising:

a base comprising:

(i) a well configured to hold a product, the well having a neck extending from the base; and (ii) an outer base portion having an outer base perimeter and a top portion extending between the neck of the well and the outer base perimeter; and a lid assembly configured to be removably coupled to the base, the lid assembly comprising:

a lid comprising: (i) an outer portion disposed on the top portion of the base and having an outer perimeter extending around the top portion of the base and extending a height from the top portion of the base; (ii) an inner portion substantially perpendicular to the outer portion, extending between the outer perimeter and disposed over the well of the base, the inner portion having a plurality of fulcrums extending from the inner portion; and (iii) a gap provided between the inner portion and the outer portion;

a depressible element extending between the outer perimeter of the outer portion, spaced from the inner portion and configured to move along the height of the outer portion; and a clamping device coupled to the lid and removably coupled to the base, the clamping device comprising a plurality of clamping elements each having: (i) an upper arm extending between a center axis of the outer portion and the outer perimeter of the outer portion; and (ii) a lower arm extending between the corresponding upper arm and the base, wherein when the depressible element is moved in a first direction toward the clamping device, a first force is applied to the clamping device causing: (i) the upper arms of the clamping device to contact corresponding fulcrums, (ii) the clamping device to flex; and (iii) the lower arms to disengage from the base.

10. The quick release container according to claim 9, wherein:

the neck comprises a protruding portion extending away from the neck toward the outer portion of the lid, and the lower arms of the clamping elements comprise one or more clamping protrusions configured to engage the protruding portion and prevent movement of the lid assembly in a second direction opposite the first direction.

11. The quick release container according to claim 9, wherein the upper arm of one of the plurality of clamping elements and the upper arm of another of the plurality of clamping elements extends in opposite directions from the center axis of the outer portion.

12. The quick release container according to claim 11, wherein the clamping device further comprises a coupling portion extending from the center axis of the outer portion and fixedly coupled to the lid.

13. The quick release container according to claim 9, wherein the clamping device comprises a hole disposed between the plurality of clamping elements, and the depressible element comprises a center portion extending from the depressible element toward the inner portion of the lid and is configured to pass through the hole when the depressible element is moved in the first direction toward the clamping device.

14. The quick release container according to claim 9, further comprising a liner disposed between the inner portion of the lid and the neck.

15. A quick release lid assembly for use with a base having a well to hold a product, the quick release lid assembly comprising:

a lid comprising: (i) an outer portion configured to be disposed around a top of the base; and (ii) an inner portion extending between the outer portion and configured to be disposed over the well of the base;

a depressible element extending between a perimeter of the outer portion, spaced from the inner portion and configured to move along a height of the outer portion; and a clamping device coupled to the lid and configured to be removably coupled to the base, the clamping device including a plurality of clamping elements, wherein the inner portion of the lid comprises one or more fulcrums extending between the inner portion and the clamping device, wherein the clamping device is configured to: (i) engage with the base when the lid is in a closed position; and (ii) disengage from the base when the depressible element is moved in a first direction toward the clamping device, causing a first force to be applied to the clamping device, causing the plurality of clamping elements to contact the one or more fulcrums, causing the plurality of clamping elements to flex, and causing the clamping device to disengage from the base.

16. The quick release lid assembly according to claim 15, the plurality of clamping elements each having: (i) a upper arm extending between a center axis of the outer portion and the perimeter of the outer portion; and (ii) a lower arm configured to extend substantially perpendicular to the upper arm between the upper arm and the base, wherein when the first force is applied to the clamping device, the corresponding upper arms of the plurality of clamping elements are configured to contact the one or more fulcrums of the inner portion of the lid and cause the plurality of clamping elements to flex and cause the corresponding lower arms of the plurality of clamping elements to disengage from the base.

17. The quick release lid assembly according to claim 16, wherein the corresponding upper arms of the plurality of clamping elements comprise a sloped portion opposing the depressible element and sloping away from the depressible element as the corresponding upper arms extend from a center axis of the outer portion toward the perimeter of the outer portion.

18. The quick release lid assembly according to claim 15, further comprising:

a biasing element coupled between the clamping device and the depressible element, wherein, when the depressible element is moved toward the clamping device, the first force is applied to the clamping device via the biasing element.

19. The quick release lid assembly according to claim 18, wherein the biasing element is a spring.

* * * * *